United States Patent [19]

Yamagishi

[11] Patent Number: 4,741,106

[45] Date of Patent: May 3, 1988

[54] POCKET KNIFE

[75] Inventor: Masami Yamagishi, Tokyo, Japan

[73] Assignee: Kai Cutlery Co., Ltd., Tokyo, Japan

[21] Appl. No.: 888,094

[22] Filed: Jul. 17, 1986

Related U.S. Application Data

[63] Continuation of Ser. No. 705,098, Feb. 25, 1985, abandoned.

[30] Foreign Application Priority Data

Dec. 12, 1984 [JP] Japan ..... 59-187385[U]

[51] Int. Cl.[4] ..... B26B 3/06

[52] U.S. Cl. ..... 30/161; 30/158; 30/159

[58] Field of Search ..... 30/158, 159, 160, 161

[56] References Cited

U.S. PATENT DOCUMENTS

| | | | |
|---|---|---|---|
| 1,584,165 | 5/1926 | Brown | 30/159 |
| 2,250,290 | 7/1941 | Berg | 30/160 |
| 3,568,315 | 3/1971 | Smith | 30/161 |
| 4,040,181 | 8/1977 | Johnson | 30/161 |
| 4,442,600 | 4/1984 | Felix-Dalichow | 30/161 |
| 4,451,982 | 6/1984 | Collins | 30/161 |

*Primary Examiner*—E. R. Kazenske
*Assistant Examiner*—Willmon Fridie, Jr.
*Attorney, Agent, or Firm*—Koda and Androlia

[57] ABSTRACT

A folding pocket knife substantially including a handle, a blade retaining lever and a blade. The blade is pivotally held in the handle wherein the engagement between a holding lever and the base of the blade, which keeps the blade out of the handle, is released by depressing the press area of the lever. The press area of the lever is covered with soft and pliable material that can be moved downward together with the press area so that the disengagement between the retaining lever and the blade can be made without pain to the finger. The whole body of the handle is covered with the soft and pliable material, but the handle may be formed with hard material except the portion over the press area so that only this portion is covered with the soft and pliable material.

2 Claims, 2 Drawing Sheets

POCKET KNIFE

This is a continuation of application Ser. No. 705,098, filed Feb. 25, 1985, now abandoned.

BACKGROUND OF THE INVENTION

1. Field of the Invention

The present invention relates to a pocket knife, and particularly to a folding pocket knife wherein the press area of a blade retaining lever is covered is covered with a soft and flexible member in order to ease the pain of the finger when depressing the press area.

2. Prior Art

A type of pocket knife has a lever which is depressed by a finger to take the blade in and out of the handle. This lever, which engages the blade to retain it, is made of iron, stainless steel, etc. and is exposed directly to the touch of the finger.

The width of the finger-contact press area of the lever is usually only about ⅛ of the thickness of the overall body of the pocket knife. Besides, for actuating the lever to operate, the press area has to be pressed with fairly strong force. These factors cause pain to the finger when operating the lever.

SUMMARY OF THE INVENTION

The object of the present invention is to eliminate the abovementioned disadvantage accompanying conventional pocket knives.

Another object of this invention is to provide a pocket knife that is free of causing pain to the finger.

The foregoing object of the invention is achieved by a unique structure, wherein the area pressed by the finger for effecting the release of the engagement between the lever and the base of the blade is covered with a soft and pliable material.

DETAILED DESCRIPTION OF THE INVENTION

Figure 1:
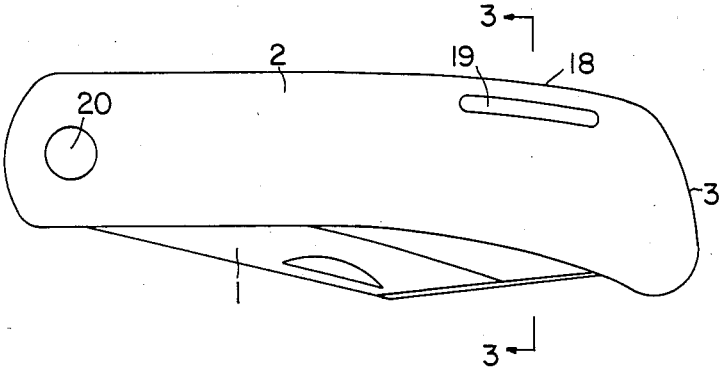
FIG. 1 is a front view of a pocket knife showing the first embodiment of this invention.
Figure 2:
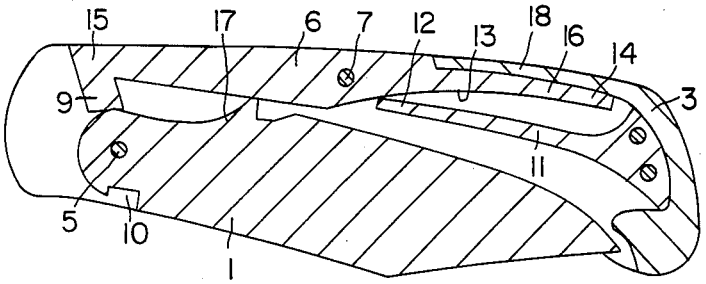
FIG. 2 is a vertical sectional view thereof.
Figure 3:
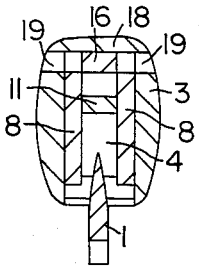
FIG. 3 is a sectional view taken along the line 3—3 of FIG. 1.

The description of the first embodiment according to the present invention will hereunder be given with reference to FIGS. 1 through 3.

The pocket knife is composed of a blade 1 and a handle 2. The handle 2 is formed with a pair of side plates 8, with a specified space 4 between them, and a cover member 3 covering the side plates 8. In the space 4, the blade 1 is housed when it is folded.

The blade 1 is held pivotally at one end of the handle 2 by means of a pin 5 in a manner to be allowed to rotate. Along the top edge of the handle 2, a lever 6 is provided in a form to extend almost the entire length of the handle 2. This lever 6 is attached to both side plates 8 by means of a rod 7 at the center of the lever 6. The lever 6 swings like a seesaw about the rod 7.

At the front end 15 of the lever 6, a downward projection 9 is formed. On the other hand, a recess 10 is formed at the base of the back end of the blade 1. By means of engagement of the projection 9 and the recess 10, the blade 1 is kept out of the handle 2, being in an open (unfolded) position. The top edge of the rear end of the lever 6 is used as a press area 16 to release engagement.

The rear portion of the handle 2 is provided with an elastic member 11. The end 12 of this elastic member 11 is in contact with the underside 13 of the lever 6 and keeps pushing the rear portion 14 of the lever 6 in an upward direction. Because of this upward pressure, the front portion 15 of the lever 6 is urged down, and the projection 9 of the lever 6 presses down the base of the blade 1 to keep the blade folded in the handle 2. When the blade 1 is unfolded into the open position, the blade 1 is locked in the open state by means of the engagement of the projection 9 of the lever 6 and the recess 10 of the blade 1.

For bringing the blade 1 back from the open position to the folded position to be stored in the handle 2, the soft and pliable member, that is, the cover member 3, covering the press area 16 of the lever 6 is pressed down in order to depress the press area 16, thereby causing the disengagement of the locking effect between the projection 9 of the lever 6 and the recess 10 of the blade 1. Thus, the blade 1 can be rotated back to the folded position.

In FIG. 2, represented by the numeral 17 is a stopper for protecting the edge of the blade 1 from any possible damage.

The whole body of the handle 2 is covered with the cover member 3 as mentioned previously. The cover member 3 is formed of soft and flexible materials, such as rubber, soft plastics, etc. The top rear edge of the press area 16 of the lever 6 is covered with a finger-contact portion 18, a part of the cover member 3. Under the finger-contact portion 18, openings 19 are formed in both sides plates 8. By means of the openings 19, the finger-contact portion 18 can be easily pressed down together with the press area 16. However, these openings 19 are not necessarily indispensable. In the Figure, the numeral 20 is a cap covering the pins.

Figure 4:
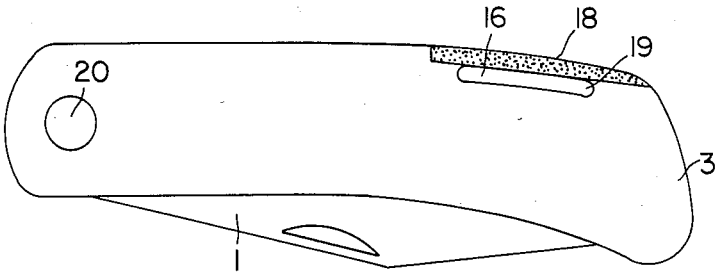
FIG. 4 is a front view of another embodiment of the present invention.

In the above embodiment, the cover member 3 is formed with soft and flexible materials. However, in the embodiment shown in FIG. 4 the cover member 3 may be formed of hard and solid materials, such as metal, wood, hard plastics, etc. except the finger contact portion 18 of the cover member 3 covering the press area 16 of the lever 6, so that the finger contact portion 18 can be made of the same kind of soft material as shown in the above embodiment. In this case, the soft materials are adhered to this finger-contact portion 18 to a form part of the cover member 3. It is the same as in the first embodiment that the opening 19 is provided under the finger contact portion, if necessary, so that the finger-contact portion can be depressed together with the press area.

The present invention is provided with such a structure that the press area of the lever is covered with a soft and pliable member. Accordingly, it is not required to directly press the hard material portion, that is, the press area 16 of the lever 6, with fingers. Instead, the press area is indirectly depressed through pushing down the soft member. Thus, the pocket knife provided by this invention has the effect of preventing the finger from feeling pain due to pressure when depressing the press area, because the area the finger direct makes contact with is formed of the soft and pliable material.

I claim:

1. A folding pocket knife, wherein a blade is pivotally held by a handle in a rotatable manner between side plates covered with a cover member, and the engagement between a lever and base of the blade is released by depressing a press area of the lever installed in the handle, said knife being characterized in that said cover member which covers said press area is a soft pliable material which is movable together with said press area, said pliable material is relatively thick and openings are provided in said cover member such that spaces are formed between the top edges of said side plates and the bottom surfaces of said soft pliable material of the cover member covering said press area.

2. A folding pocket knife according to claim 1, wherein said soft and pliable material covering said handle including the portion over said press area of the lever is rubber.

* * * * *